US010061239B2

(12) United States Patent
Kikuchi et al.

(10) Patent No.: US 10,061,239 B2
(45) Date of Patent: Aug. 28, 2018

(54) FIXING DEVICE AND IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Kazuhiko Kikuchi, Yokohama Kanagawa (JP); Kazutoshi Takahashi, Mishima Shizuoka (JP); Toshihiro Sone, Yokohama Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/459,108

(22) Filed: Mar. 15, 2017

(65) Prior Publication Data

US 2018/0210381 A1 Jul. 26, 2018

(30) Foreign Application Priority Data

Jan. 26, 2017 (JP) ..... 2017-012103

(51) Int. Cl.
*G03G 15/20* (2006.01)

(52) U.S. Cl.
CPC . *G03G 15/2053* (2013.01); *G03G 2215/2035* (2013.01)

(58) Field of Classification Search
CPC ..... G03G 15/2053; G03G 15/2089; G03G 2215/2035; G03G 2215/2009
See application file for complete search history.

(56) References Cited

U.S. PATENT DOCUMENTS 8,706,014 B2 * 4/2014 Matsumoto ..... G03G 15/206 399/329
2006/0210331 A1 * 9/2006 Baba ..... G03G 15/2053 399/329
2007/0212093 A1 9/2007 Maeda et al.
2008/0124146 A1 5/2008 Bae
2008/0149211 A1 6/2008 Yamada et al.
2008/0199232 A1 * 8/2008 Takemura ..... G03G 15/2053 399/329
2010/0266307 A1 10/2010 Kagawa
(Continued)

FOREIGN PATENT DOCUMENTS

EP 1925989 5/2008

OTHER PUBLICATIONS

Extended European Search Report for European Patent Application No. 17193512.5 dated Apr. 20, 2018.
(Continued)

*Primary Examiner* — Gregory H Curran
(74) *Attorney, Agent, or Firm* — Amin, Turocy & Watson LLP

(57) ABSTRACT

A fixing device according to an embodiment includes a first rotator, a belt, and a second rotator. The belt forms a nip by abutting onto a surface of the first rotator. The second rotator is disposed to abut onto an inner circumferential surface of the belt. The second rotator presses the belt against the first rotator such that the dynamic frictional force between the inner circumferential surface of the belt and the second rotator becomes equal to or smaller than 0.98 N.

10 Claims, 6 Drawing Sheets

(56) References Cited

U.S. PATENT DOCUMENTS

| | | | | |
|---|---|---|---|---|
| 2013/0216282 | A1* | 8/2013 | Ohtsu ..... | G03G 15/2053<br>399/329 |
| 2014/0086651 | A1 | 3/2014 | Otsu | |
| 2014/0341621 | A1 | 11/2014 | Omori et al. | |
| 2014/0369727 | A1 | 12/2014 | Tsunoda | |

OTHER PUBLICATIONS

Anonymous, "Surface roughness", Wikipedia, Apr. 10, 2018, https://en.wikipedia.org/wiki/Surface_roughness.

* cited by examiner

FIXING DEVICE AND IMAGE FORMING APPARATUS

CROSS-REFERENCE TO RELATED APPLICATIONS

This application is based upon and claims the benefit of priority from Japanese Patent Application No. 2017-012103, filed Jan. 26, 2017, the entire contents of which are incorporated herein by reference.

FIELD

An embodiment described herein relates generally to a fixing device and an image forming apparatus.

BACKGROUND

An image forming apparatus includes a fixing device. The fixing device fixes a toner on a sheet through heat fixing. As the fixing device, a belt fixing device and a roller fixing device are known.

The belt fixing device includes a roller and a belt. In the belt fixing device, a fixation nip is formed by the roller and the belt abutting onto each other.

The roller fixing device includes a pair of rollers. In the roller fixing device, a fixation nip is formed by the pair of rollers abutting onto each other.

The belt fixing device can form a fixation nip that has a wider nip width than a fixation nip formed by the roller fixing device.

However, when the nip width is large, there is a problem that a wrinkle is likely to be generated on a sheet.

DETAILED DESCRIPTION

An object of the exemplary embodiment is to provide a fixing device and an image forming apparatus in which a wrinkle is unlikely to be generated on a sheet even with a wide nip width.

A fixing device according to an embodiment includes a first rotator, a belt, and a second rotator. The belt forms a nip by abutting onto a surface of the first rotator. The second rotator is disposed to abut onto an inner circumferential surface of the belt. The second rotator presses the belt against the first rotator such that the dynamic frictional force between the inner circumferential surface of the belt and the second rotator becomes equal to or smaller than 0.98 N.

EMBODIMENT

Hereinafter, a fixing device and an image forming apparatus according to an embodiment will be described with reference to drawings.

Figure 1:
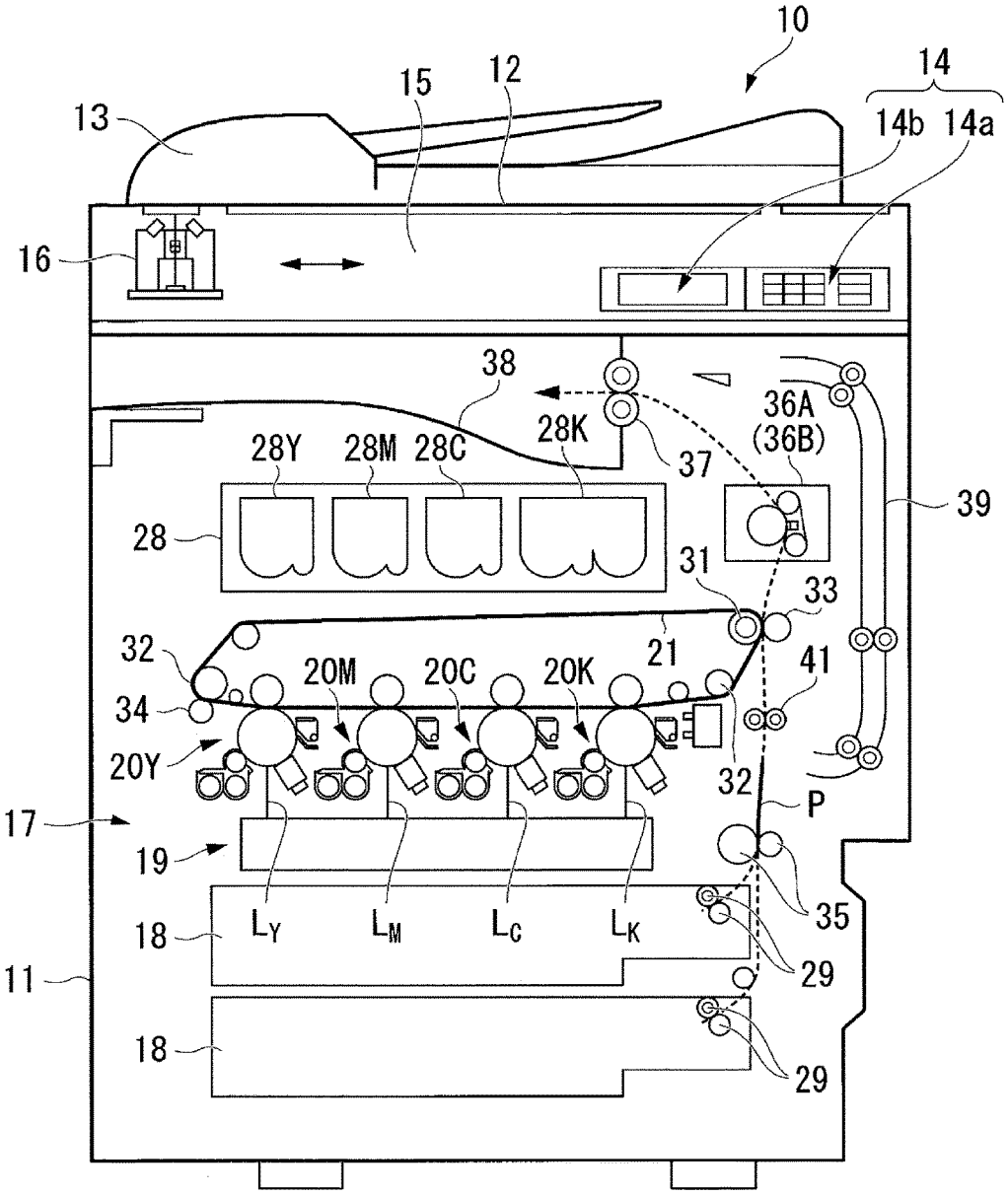
FIG. 1 is a schematic sectional view illustrating a configuration example of an image forming apparatus according to an embodiment.
Figure 2:
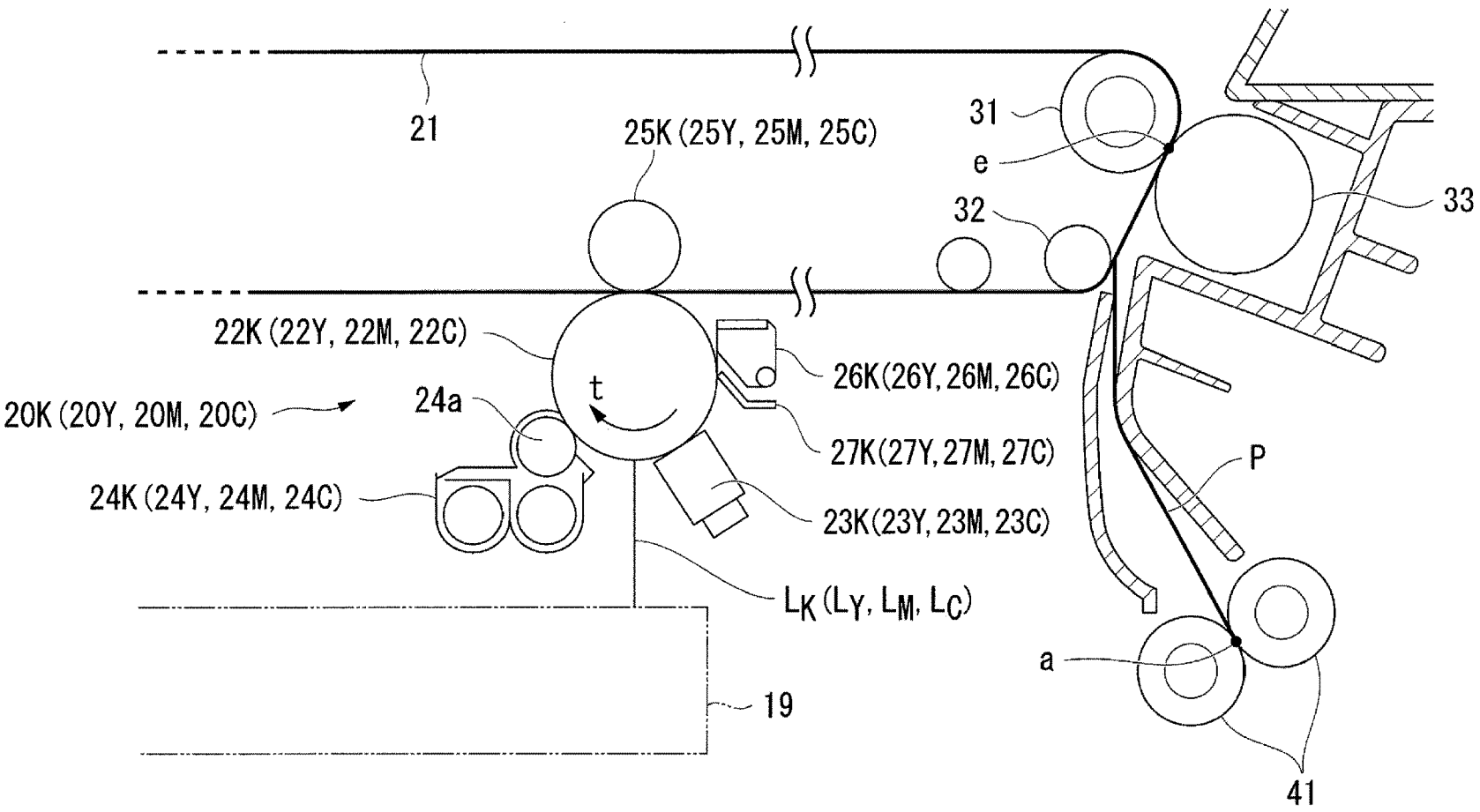
FIG. 2 is a schematic sectional view illustrating a portion of an image forming unit in an enlarged manner.

FIG. 1 is a schematic sectional view illustrating a configuration example of the image forming apparatus according to the embodiment. FIG. 2 is a schematic sectional view illustrating a portion of an image forming unit according to the embodiment in an enlarged manner. In FIGS. 1 and 2, dimensions and shapes of each member are exaggerated or simplified for the sake of clarity (the same applies to the drawings below).

As illustrated in FIG. 1, an image forming apparatus 10 according to the embodiment is, for example, a multifunction peripheral (MFP), a printer, a copying machine, or the like. Hereinafter, a case in which the image forming apparatus 10 is an MFP will be described.

A document table 12 which contains transparent glass is provided on an upper portion of a main body 11 of the image forming apparatus 10. An automatic document feeding unit (ADF) 13 is provided on the document table 12. An operation unit 14 is provided on the upper portion of the main body 11. The operation unit 14 includes an operation panel 14*a* provided with various keys and includes a touch-panel type display unit 14*b*.

A scanner unit 15, which is a reading device, is provided below the ADF 13. The scanner unit 15 reads a document fed by the ADF 13 or a document placed on the document table 12. The scanner unit 15 generates image data of an image on a document. For example, the scanner unit 15 includes an image sensor 16. For example, the image sensor 16 may be a contact image sensor.

The image sensor 16 moves along the document table 12 in a case of reading an image on a document placed on the document table 12. The image sensor 16 reads one page of the document while reading the image on the document line by line.

In a case of reading an image on a document fed by the ADF 13, the image sensor 16 reads the fed document at a fixed position illustrated in FIG. 1.

The main body 11 of the image forming apparatus 10 includes a printing unit 17 provided in a central portion in a height direction. The main body 11 includes a plurality of paper feeding cassettes 18 provided in a lower portion.

The paper feeding cassette 18 accommodates sheets P having various sizes. The paper feeding cassette 18 accommodates the sheets P having various sizes using a central position as a standard position. The sheets P having various sizes are aligned such that the center of each sheet Pin a width direction, which is orthogonal to a transportation direction, is positioned at a fixed position.

The paper feeding cassette 18 includes a paper feeding mechanism 29. The paper feeding mechanism 29 takes out the sheets P from the paper feeding cassette 18 one by one and feeds the sheets P to a transportation path. For example, the paper feeding mechanism 29 may include a pick-up roller, a separation roller, and a paper feeding roller.

Hereinafter, a direction, which is parallel to a transportation surface of the sheet P in the image forming apparatus 10 and is orthogonal to the transportation direction of the sheet P, will be referred to as an "orthogonal-to-transportation direction".

The printing unit 17 forms an image on the sheet P on the basis of image data of an image read by the scanner unit 15, image data created by a personal computer, or the like. The printing unit 17 is, for example, a tandem type color printer.

The printing unit 17 includes image forming units 20Y, 20M, 20C, and 20K, which respectively correspond to yellow (Y), magenta (M), cyan (C), and black (K), an exposure device 19, and an intermediate transfer belt 21.

The image forming units 20Y, 20M, 20C, and 20K are disposed below the intermediate transfer belt 21. The image forming units 20Y, 20M, 20C, and 20K are provided in this order in a movement direction of the intermediate transfer belt 21 (a direction from the left side to the right side in FIG. 1). The image forming units 20Y, 20M, 20C, and 20K are disposed in parallel in a direction from an upstream side to a downstream side.

The exposure device 19 irradiates the image forming units 20Y, 20M, 20C, and 20K with exposure light rays $L_Y$, $L_M$, $L_C$, and $L_K$, respectively.

The exposure device 19 may be configured to generate a laser scanning beam as the exposure light ray. The exposure device 19 may include a solid state scanning element such as an LED that generates an exposure light ray.

The configurations of the image forming units 20Y, 20M, 20C, and 20K are the same as one another except for the toner color. Any of an ordinary color toner and a decolorable toner may be used as the toner. Here, the decolorable toner is a toner which becomes transparent when being heated at a certain temperature or higher.

Hereinafter, the configuration common to the image forming units 20Y, 20M, 20C, and 20K will be described using the image forming unit 20K as an example.

As illustrated in FIG. 2, the image forming unit 20K includes a photosensitive drum 22K. The photosensitive drum 22K is an image carrier. In the vicinity of the photosensitive drum 22K, a charging device 23K, a developing device 24K, a primary transfer roller 25K, a cleaner 26K, a blade 27K and the like are arranged in a rotation direction t.

The charging device 23K of the image forming unit 20K uniformly charges a surface of the photosensitive drum 22K.

The exposure device 19 generates an exposure light ray $L_K$ that is modulated on the basis of image data. The surface of the photosensitive drum 22K is exposed to the exposure light ray $L_K$. The exposure device 19 forms an electrostatic latent image on the photosensitive drum 22K.

The developing device 24K supplies a black toner to the photosensitive drum 22K by using a developing roller 24*a* to which a developing bias is applied. The developing device 24K develops the electrostatic latent image on the photosensitive drum 22K.

The cleaner 26K includes the blade 27K which abuts onto the photosensitive drum 22K. The blade 27K removes a toner remaining on the surface of the photosensitive drum 22K.

The image forming units 20Y, 20M, and 20C respectively include photosensitive drums (image carriers) 22Y, 22M, and 22C, charging devices 23Y, 23M, and 23C, primary transfer rollers 25Y, 25M, and 25C, cleaners 26Y, 26M, and 26C, and blades 27Y, 27M, and 27C which are similar to the photosensitive drum 22K, the charging device 23K, the primary transfer roller 25K, the cleaner 26K, and the blade 27K of the image forming unit 20K.

The image forming units 20Y, 20M, and 20C respectively include developing devices 24Y, 24M, and 24C, which are different only in toner color and which are similar to the developing device 24K of the image forming unit 20K.

As illustrated in FIG. 1, a toner cartridge 28 is disposed above the image forming units 20Y, 20M, 20C, and 20K.

The toner cartridge 28 supplies a toner to each of the developing devices 24Y, 24M, 24C, and 24K. The toner cartridge 28 includes toner cartridges 28Y, 28M, 28C, and 28K. The toner cartridges 28Y, 28M, 28C, and 28K accommodate a yellow toner, a magenta toner, a cyan toner, and a black toner, respectively.

The intermediate transfer belt 21 moves in a circulating manner. The intermediate transfer belt 21 is stretched among a driving roller 31 and a plurality of driven rollers 32 (refer to FIG. 1).

As illustrated in FIG. 2, the intermediate transfer belt 21 is in contact with the photosensitive drums 22Y, 22M, 22C, and 22K from the upper side in FIG. 2.

The primary transfer roller 25K (25Y, 25M, and 25C) is disposed inside the intermediate transfer belt 21 at a position which faces the photosensitive drum 22K (22Y, 22M, and 22C).

When primary transfer voltage is applied to the primary transfer roller 25K (25Y, 25M, and 25C), the primary transfer roller 25K (25Y, 25M, and 25C) primarily transfers a toner image on the photosensitive drum 22K (22Y, 22M, and 22C) to the intermediate transfer belt 21.

The driving roller 31 faces a secondary transfer roller with the intermediate transfer belt 21 interposed therebetween. A position at which the intermediate transfer belt 21 and the secondary transfer roller 33 abut onto each other is a secondary transfer position (refer to a point e in FIG. 2).

Secondary transfer voltage is applied to the secondary transfer roller 33 when the sheet P passes through the secondary transfer position. When the secondary transfer voltage is applied to the secondary transfer roller 33, the secondary transfer roller 33 secondarily transfers a toner image on the intermediate transfer belt 21 to the sheet P.

As illustrated in FIG. 1, a belt cleaner 34 is disposed in the vicinity of the driven roller 32. The belt cleaner 34 removes a transfer toner remaining on the intermediate transfer belt 21 from the intermediate transfer belt 21.

As illustrated in FIG. 1, paper feeding rollers 35 and registration rollers 41 are provided in a transportation path between the paper feeding cassette 18 and the secondary transfer roller 33. The paper feeding rollers 35 transport the sheet P, which is taken out of the paper feeding cassette 18, by using the paper feeding mechanism 29. The registration rollers 41 adjust the position of a leading end of the sheet P, which is supplied from the paper feeding rollers 35, at a position where the registration rollers 41 abut onto each other. The position where the registration rollers 41 abut onto each other (refer to a point a in FIG. 2) is a registration position. The registration rollers 41 transport the sheet P such that a leading end of a toner image transfer region on the sheet P reaches the secondary transfer position when a leading end of a toner image reaches the secondary transfer position. The toner image transfer region is a region on the sheet P other than a void region which is formed on an end portion of the sheet P.

A fixing device 36A is disposed on the downstream side (the upper side in FIG. 1) of the secondary transfer roller 33 in the transportation direction of the sheet P.

Transportation rollers 37 are disposed on the downstream side (the upper left side in FIG. 1) of the fixing device 36A in the transportation direction of the sheet P. The transportation rollers 37 discharge the sheet P to a sheet discharge portion 38.

A reverse transportation path 39 is disposed on the downstream side (the right side in FIG. 1) of the fixing device 36A in the transportation direction of the sheet P. The reverse transportation path 39 reverses the sheet P and guides the sheet P toward the secondary transfer roller 33. The reverse transportation path 39 is used at the time of double-sided printing.

Next, the fixing device 36A will be described in detail.

Figure 3:
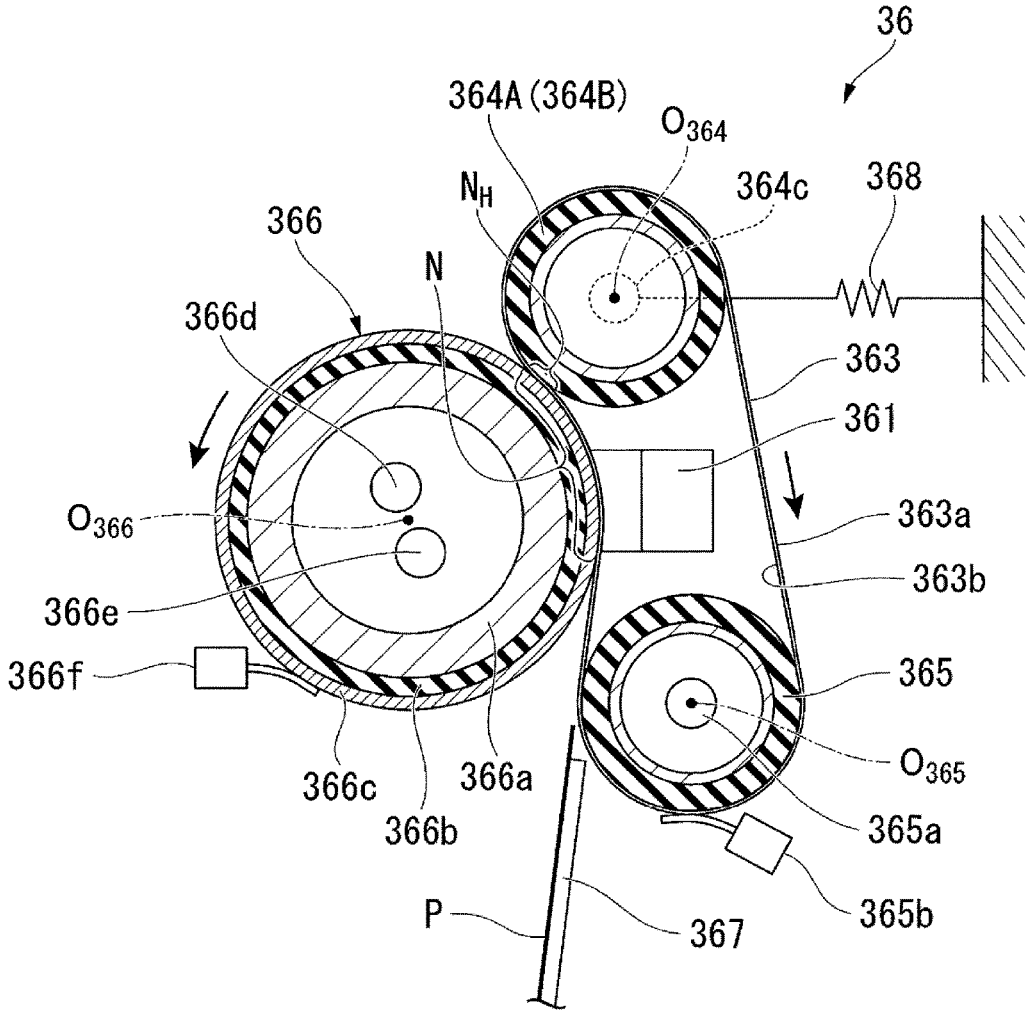
FIG. 3 is a schematic sectional view illustrating a configuration example of a main portion of a fixing device.
Figure 4:
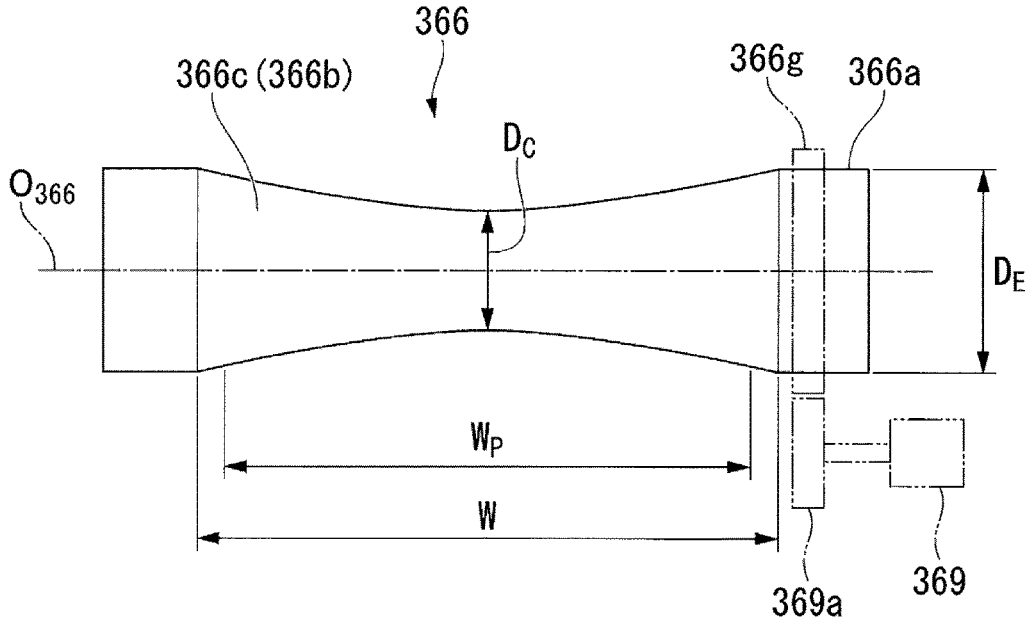
FIG. 4 is a schematic plan view illustrating the external shape of a heat roller.
Figure 5:
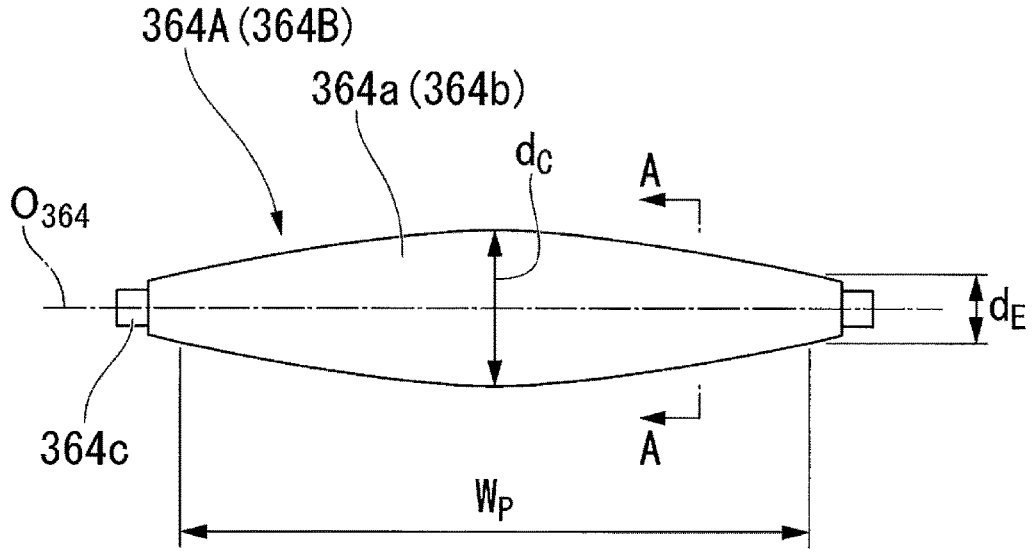
FIG. 5 is a schematic plan view illustrating the external shape of a press roller.
Figure 6:
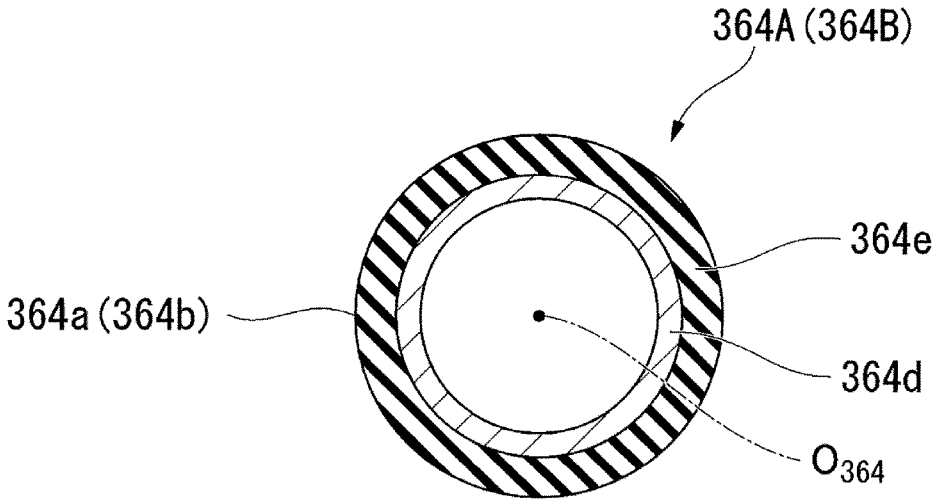
FIG. 6 is a schematic sectional view taken along line A-A in FIG. 5.

FIG. 3 is a schematic sectional view illustrating a configuration example of a main portion of the fixing device according to the embodiment. FIG. 4 is a schematic plan view illustrating the external shape of a heat roller of the fixing device according to the embodiment. FIG. 5 is a schematic plan view illustrating the external shape of a press roller. FIG. 6 is a schematic sectional view taken along line A-A in FIG. 5.

As illustrated in FIG. 3, the fixing device 36A includes a belt 363, a heat roller 366 (a first rotator), a belt heat roller 365, a press roller 364A (a second rotator), a pad 361, and thermisters 366*f* and 365*b*. The fixing device 36A is surrounded by a case (not shown). An entry opening and a discharge opening are formed in the case. The sheet P can enter the case via the entry opening. The sheet P can be discharged via the discharge opening.

The transportation direction of the sheet P entering the fixing device 36A is a direction from the lower side to the upper side in FIG. 3. The entry opening of the fixing device 36A is provided on the lower side in FIG. 3. A transportation guide 367 is provided below the entry opening of the fixing device 36A. The transportation guide 367 guides the sheet P which enters the fixing device 36A via the entry opening.

The discharge opening of the fixing device 36A is provided on the upper side in FIG. 3.

The belt 363 is an endless belt. The belt width of the belt 363 is larger than the width of the widest sheet P which can be fed.

The belt 363 is formed of heat resistant material that is resistant to heating by the heat roller 366, which will be described later. Fluororesin may be laminated on an outer circumferential surface 363*a* of the belt 363. An inner circumferential surface 363*b* of the belt 363 is formed of a material such that the dynamic frictional force between the inner circumferential surface 363*b* and the press roller 364A, which will be described later, becomes equal to or smaller than 0.98 N. A dynamic frictional force measuring method will be described later. The surface roughness of the inner circumferential surface 363*b* of the belt 363 may be equal to or greater than 1 and equal to or smaller than 3 in terms of arithmetic average roughness Ra.

For the belt 363, for example, a polyimide base material, of which an outer circumferential surface is coated with a conductive polytetrafluoroethylene (PFA) tube, may be used. For example, the thickness of the polyimide base material may be equal to or greater than 60 μm and equal to or smaller than 70 μm.

The belt 363 is stretched between a plurality of rollers with the inner circumferential surface 363*b*. In this embodiment, the belt 363 is stretched between the belt heat roller 365 (which will be described later) and the press roller 364A with the inner circumferential surface 363*b*.

The belt 363 is wound on a portion of the heat roller 366, which will be described later, with the outer circumferential surface 363*a*.

The heat roller 366 includes a cored bar 366*a*, an elastic layer 366*b*, and a release layer 366*c*.

The cored bar 366*a* is a tube-like member made of metal. For example, the cored bar 366*a* may be formed of aluminum alloy.

The opposite end portions of the cored bar 366*a* are supported by a supporting member (not shown) in the fixing device 36A through a bearing (not shown). The cored bar 366*a* extends along a central axis $O_{366}$ of the heat roller 366. The central axis $O_{366}$ extends in a depth direction of FIG. 3. The cored bar 366*a* can rotate around the central axis $O_{366}$.

As illustrated in FIG. 4, a gear 366*g* is provided on an axial end portion of the cored bar 366*a*. The gear 366*g* transmits a rotational driving force to the heat roller 366. The rotational driving force transmitted by the gear 366*g* is generated by a driving motor 369 (motor). The rotational driving force generated by the driving motor 369 is transmitted to the gear 366*g* through a transmission mechanism 369*a* connected to the driving motor 369. The type of the driving motor 369 is not particularly limited. For example, for the driving motor 369, a DC brushless motor, a pulse motor, an ultrasonic motor, or the like may be used.

When the rotational driving force is transmitted to the gear 366*g*, the heat roller 366 rotates around the central axis $O_{366}$ in a counter clockwise direction of FIG. 3.

As illustrated in FIG. 3, the elastic layer 366*b* is stacked on an outer circumferential surface of the cored bar 366*a*. As illustrated in FIG. 4, the width of the elastic layer 366*b* in an axial direction of the cored bar 366*a* is smaller than the entire width of the cored bar 366*a*. The width of the elastic layer 366*b* in the axial direction of the cored bar 366*a* is larger than the width of the widest sheet P which can be fed. The elastic layer 366*b* is formed in a central portion in the axial direction of the cored bar 366*a*. The elastic layer 366*b* is formed over an area wider than a passage region $W_P$ of the sheet P.

The elastic layer 366*b* is formed of a heat resistant rubber material. The elastic layer 366*b* may be formed of, for example, silicon rubber.

As illustrated in FIG. 3, the release layer 366*c* is stacked on an outer circumferential surface of the elastic layer 366*b*. As illustrated in FIG. 4, the release layer 366*c* is formed over an area that covers the elastic layer 366*b*.

The release layer 366*c* is formed of a resin material which is excellent in toner releasing property. For example, the release layer 366*c* may be formed of fluororesin. For example, examples of a material suitable for the release layer 366*c* include PFA.

An outer circumferential surface of the heat roller 366 is formed to have a "reverse crown shape" at least for an area corresponding to the passage region $W_P$ of the sheet P. Here, the "reverse crown shape" is a shape in which the outer diameter gradually increases from the axial center toward the opposite end portions. The maximum diameter and the minimum diameter of the reverse crown shape of the heat roller 366 are represented by $D_E$ and $D_C$, respectively (where $D_C<D_E$). For example, a difference $D_E-D_C$ (hereinafter, referred to as a reverse crown amount) in the heat roller 366 may be set to 100 μm.

The reverse crown shape of the heat roller 366 may be formed by processing the outer circumferential surface of the cored bar 366*a*. The reverse crown shape of the heat roller 366 may be formed by changing the thickness of at least one of the elastic layer 366*b* and the release layer 366*c*.

A specific example of the dimensions of the heat roller 366 will be given. For example, if W=319 mm, an effective roller width $W_P$ may be 300 mm. The release layer 366*c* and the elastic layer 366*b* are formed in the effective roller width. The reverse crown shape is formed in the effective roller width. $D_E$ and $D_C$ of the reverse crown shape in the effective roller width may be 39.98 mm and 39.88 mm, respectively.

As the cored bar 366*a* of the heat roller 366, an aluminum alloy pipe material, of which the thickness is 0.9 mm, may be used. As the elastic layer 366*b*, a silicon rubber layer, of which the thickness is 200 μm, may be used. As the release layer 366*c*, PFA, of which the thickness is 50 μm, may be used. For example, the reverse crown shape may be formed by processing a surface of the cored bar 366*a*.

As illustrated in FIG. 3, halogen lamps 366*d* and 366*e* (heat sources) are inserted into the heat roller 366. Each of the opposite end portions of the halogen lamps 366*d* and 366*e* protrudes out of the cored bar 366*a*. The opposite end portions of the halogen lamps 366*d* and 366*e* are supported by a lamp holder (not shown) in the fixing device 36A.

The halogen lamps 366*d* and 366*e* heat the heat roller 366. Lighting control of the halogen lamps 366*d* and 366*e* can be individually performed. For example, the fixing device 36A may have a normal fixing mode and a low temperature fixing mode. In the normal fixing mode, both of the halogen lamps 366*d* and 366*e* may be lighted. In the low temperature fixing mode, one of the halogen lamps 366*d* and 366*e* may be lighted.

The low temperature fixing mode may be used for fixing an image developed with the decolorable toner.

The belt heat roller 365 and the press roller 364A are disposed inside the belt 363. The belt heat roller 365 and the press roller 364A apply a tensile force to the belt 363. The belt heat roller 365 and the press roller 364A are arranged in this order in the transportation direction of the sheet P in the fixing device 36A.

The belt heat roller 365 is disposed closer to the transportation guide 367 than the heat roller 366 is. The belt heat roller 365 and the heat roller 366 are separated from each other.

The belt heat roller 365 is supported by a supporting member (not shown) in the fixing device 36A via a bearing (not shown). The belt heat roller 365 can rotate around a central axis $O_{365}$ which extends in the depth direction of FIG. 3.

The belt heat roller 365 may be pressed by a tension spring (not shown) or the like. The belt heat roller 365 may apply a tensile force to the belt 363 by being pressed by the tension spring. However, in this embodiment, for example, the position of the central axis $O_{365}$ of the belt heat roller 365 is fixed with respect to the supporting member (not shown) of the fixing device 36A.

The belt heat roller 365 includes a cored bar which is made of metal. A halogen lamp 365*a* is inserted into the cored bar of the belt heat roller 365. The halogen lamp 365*a* heats the cored bar of the belt heat roller 365. The temperature at which the halogen lamp 365*a* performs the heating is set such that a temperature decrease in a nip (which will be described later) becomes equal to or smaller than the allowable limit.

The outermost layer of the belt heat roller 365 may be provided with an elastic layer. In this case, as the outermost layer of the halogen lamp 365*a*, a layer coated with a material having high releasing properties may be used. For example, a PFA coat or the like is used for the coating.

The press roller 364A is disposed above the central axis $O_{366}$ of the heat roller 366 with the belt 363 interposed therebetween. The press roller 364A presses the heat roller 366 with the belt 363 interposed therebetween. A portion of the belt 363 which faces the heat roller 366 between the press roller 364A and the belt heat roller 365 is wound on the heat roller 366.

The press roller 364A is pressed by a pressing spring 368 in a direction from the right side to the left side in FIG. 3. The pressing spring 368 is fixed to the supporting member (not shown) of the fixing device 36A. The pressing spring 368 applies a tensile force to the belt 363. Furthermore, the pressing spring 368 presses the press roller 364A against the heat roller 366.

A nip N in the fixing device 36A is formed at a position where the heat roller 366 and the belt 363 abut onto each other if the sheet P is not interposed therebetween. The length of the nip N in the orthogonal-to-transportation direction is larger than the length of the passage region $W_P$ of the sheet P. The width of the nip N in a circumferential direction of the heat roller 366 (hereinafter, the nip width) is determined according to the quantity of heat required for heat fixing of a toner image which is transferred to the sheet P. The nip width may be set to be, for example, equal to or greater than 12 mm and equal to or smaller than 20 mm. Particularly, in a case of fixing a toner image formed with a decolorable toner, the nip width is preferably equal to or greater than 18 mm.

A high pressure nip section $N_H$ is formed in a region in the nip N in which the heat roller 366 and the press roller 364A face each other. The sheet P passing through the high pressure nip section $N_H$ receives a pressurizing force. The pressurizing force in the high pressure nip section $N_H$ is larger than that in the other portion of the nip N which is not pressed by the press roller 364A.

The pad 361 is disposed on an inner portion of the belt 363 which faces the nip N. The pad 361 is pressed against the belt 363 by a spring (not shown) or the like. The pad 361 has the same length as the nip N. The pad 361 is disposed close to the transportation guide 367 in a nip width direction of the nip N. The pad 361 stabilizes the nip width of the nip N.

As a material for the pad 361, for example, silicon rubber may be used. In this case, a low friction coat is formed on a surface of the pad 361 which abuts onto the inner circumferential surface 363*b*.

As illustrated in FIG. 5, an outer circumferential surface 364*a* of the press roller 364A is formed to have a "normal crown shape" at least for an area corresponding to the passage region $W_P$ of the sheet P. Here, the "normal crown shape" is a shape in which the outer diameter gradually decreases from the axial center toward the opposite end portions. The maximum diameter and the minimum diameter of the normal crown shape of the press roller 364A are represented by $d_C$ and $d_E$, respectively (where $d_E<d_C$). For example, a difference $d_E-d_C$ (hereinafter, referred to as a normal crown amount) in the press roller 364A is determined according to the reverse crown amount of the heat roller 366 such that pressure distribution at the abutting portion is suitable.

Here, a state where "pressure distribution at the abutting portion is suitable" is a state where the nip width is substantially uniform in the axial direction.

In the embodiment, as illustrated in FIG. 6, the press roller 364A includes a cored bar 364*d* and an elastic layer 364*e*.

The cored bar 364*d* is made of metal. As illustrated in FIG. 5, a rotational shaft 364*c* extends at the opposite end portions of the cored bar 364*d*. The rotational shaft 364*c* is coaxial with the central axis $O_{364}$. The rotational shaft 364*c* is supported by a supporting member (not shown) in the fixing device 36A via a bearing (not shown). The rotational shaft 364*c* can rotate around the central axis $O_{364}$.

The elastic layer 364*e* is stacked on an outer circumferential surface of the cored bar 364*d*. The elastic layer 364*e* may be constituted by a rubber layer. For example, the elastic layer 364*e* may be constituted by a silicon rubber layer. The rubber hardness (JIS K 6253) of a rubber layer used for the elastic layer 364*e* may be equal to or greater than A55 and equal to or smaller than A65, for example. The thickness of the elastic layer 364*e* may be equal to or greater than 1 mm and equal to or smaller than 3 mm, for example.

The outer circumferential surface 364*a* of the press roller 364A in the embodiment is formed by a surface of the elastic layer 364*e*.

The normal crown shape of the press roller 364A may be formed by processing the outer circumferential surface of the cored bar 364*d*. The normal crown shape of the press roller 364A may be formed by changing the thickness of the elastic layer 364*e*.

Regarding the normal crown shape of the press roller 364A corresponding to the reverse crown amount of 100 μm, which is the above-described specific example of the dimensions of the heat roller 366, $d_E$ may be 20.32 mm and $d_C$ may be 21 mm (the normal crown amount of 680 μm) if the average thickness of the elastic layer 364*e* is 2 mm.

As illustrated in FIG. 3, the thermister 366*f* abuts onto the outer circumferential surface of the heat roller 366. The thermister 366*f* detects the temperature of the outer circumferential surface of the heat roller 366. The temperature of the outer circumferential surface of the heat roller 366 that is detected by the thermister 366*f* is used for temperature control of the heat roller 366 in the fixing device 36A.

The thermister 365*b* abuts onto the outer circumferential surface 363*a* of the belt 363 which is hung around the belt heat roller 365. The thermister 365*b* detects the temperature of the outer circumferential surface 363*a* of the belt 363. The temperature of the outer circumferential surface 363*a* of the belt 363 that is detected by the thermister 365*b* is used for temperature control of the belt heat roller 365 in the fixing device 36A.

A method of measuring the dynamic frictional force between the inner circumferential surface 363*b* of the belt 363 and the press roller 364A will be described.

Figure 7:
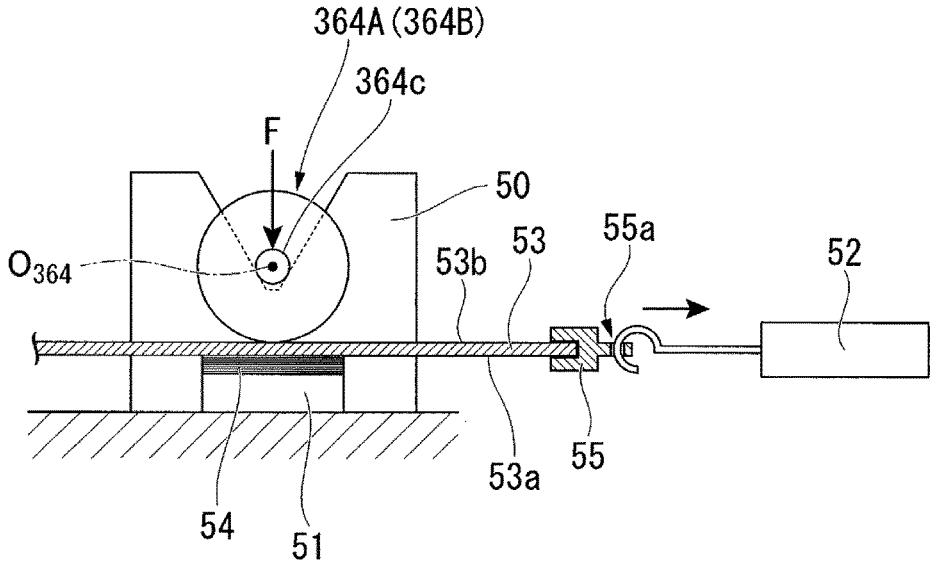
FIG. 7 is a schematic view illustrating a dynamic frictional force measuring method.

FIG. 7 is a schematic view illustrating a dynamic frictional force measuring method.

As illustrated in FIG. 7, the dynamic frictional force between the inner circumferential surface 363*b* of the belt 363 and the press roller 364A is measured in a state where a test belt 53 is interposed between a sheet 54 for measurement and the press roller 364A.

The sheet 54 for measurement is mounted on an upper surface of a supporting table 51. The sheet 54 is an "Askul MULTI PAPER MINUS 6%" manufactured by ASKUL Corporation. The basis weight of the sheet 54 is 61 g/m$^2$ (corresponding to a thickness of 0.078 mm and a density of 0.78 g/cm$^3$). The static frictional coefficient and the dynamic frictional coefficient of the sheet 54 are 0.51 and 0.42, respectively.

Fifty sheets 54 are stacked on the supporting table 51. The sheets 54 are stacked on the supporting table 51 while being held so as not to slip on each other during the measurement.

The opposite ends of the rotational shaft 364*c* of the press roller 364A are supported by a V-block 50. The central axis $O_{364}$ of the press roller 364A is held at a predetermined height with respect to the uppermost surface of the sheet 54. The central axis $O_{364}$ of the press roller 364A is held at a height at which the normal force from the test belt 53 becomes approximately 10N when the test belt 53 is placed on the sheet 54.

The press roller 364A is held on the V-block 50 by using an appropriate holding jig. The holding jig holds the press roller 364A such that the press roller 364A does not rotate around the central axis $O_{364}$ during the measurement of the dynamic frictional force.

The test belt 53 is formed of the same material as the belt 363 except that the test belt 53 is formed into a sheet-like shape. The test belt 53 may be formed by cutting the belt 363.

The test belt 53 includes a first surface 53*a* and a second surface 53*b* which correspond to the outer circumferential surface 363*a* and the inner circumferential surface 363*b* of the belt 363, respectively.

The first surface 53*a* of the test belt 53 is disposed to face the uppermost surface of the sheet 54. The second surface 53*b* of the test belt 53 abuts onto the press roller 364A.

An end portion of the test belt 53 in a direction orthogonal to the central axis $O_{364}$ is clamped by a clamper 55. The clamper 55 includes an engage portion 55*a* which can be engaged with an attachment for measurement 52*a* of a force gauge 52. The type of the force gauge 52 is not limited as long as it is possible to measure a tensile force.

As described above, when the test belt 53 and the press roller 364A are set, a measurer mounts the attachment for measurement 52*a* of the force gauge 52 onto the engage portion 55*a*. Thereafter, the force gauge 52 is pulled in a direction which is parallel to the sheet 54 and orthogonal to the central axis $O_{364}$ by the measurer or a measurement robot. When the test belt 53 starts to move, the measured value of the force gauge 52 in a stable state is set as the dynamic frictional force.

Operations of the image forming apparatus 10 will be described.

The image forming apparatus 10 according to the embodiment forms an image on the sheet P on the basis of image data input to the printing unit 17. As the image data, image data of an image read by the scanner unit 15, image data created by a personal computer, or the like is used.

In the printing unit 17, the exposure device 19 irradiates the image forming units 20Y, 20M, 20C, and 20K with the exposure light rays $L_Y$, $L_M$, $L_C$, and $L_K$, respectively on the basis of image data corresponding to Y, M, C, and K.

In the image forming units 20Y, 20M, 20C, and 20K, electrostatic latent images are formed on the photosensitive drums 22Y, 22M, 22C and 22K by the exposure light rays $L_Y$, $L_M$, $L_C$, and $L_K$. The developing devices 24Y, 24M, 24C, and 24K in the image forming units 20Y, 20M, 20C, and 20K develop the electrostatic latent images on the photosensitive drums 22Y, 22M, 22C and 22K by using toners of Y, M, C, and K, respectively.

Toner images on the photosensitive drums 22Y, 22M, 22C and 22K are primarily transferred to the intermediate transfer belt 21 at respective primary transfer positions by the primary transfer rollers 25K, 25Y, 25M, and 25C.

In this manner, the toner images of Y, M, C, and K which are primarily transferred onto the intermediate transfer belt 21 are stacked as the intermediate transfer belt 21 moves.

In parallel to the above-described image forming operation, the printing unit 17 transports the sheet P.

The sheet P is fed from the paper feeding cassette 18 by the paper feeding mechanism 29. The leading end of the sheet P is pointed at the registration roller 41 by the paper feeding rollers 35. The position of the leading end of the sheet P is adjusted by the registration rollers 41.

Thereafter, the registration rollers 41 transport the sheet P. A time at which the registration rollers 41 transport the sheet P is set such that the leading end of the toner image on the intermediate transfer belt 21 and the leading end of the toner image transfer region on the sheet P reach the secondary transfer position at the same time.

When the sheet P moves to the secondary transfer position, a secondary transfer voltage is applied to the secondary transfer roller 33. The toner image on the intermediate transfer belt 21 is secondarily transferred to the sheet P as the secondary transfer roller 33 rotates.

The sheet P to which the toner image is secondarily transferred enters into the fixing device 36A via the entry opening while being guided by the transportation guide 367. The sheet P passes through the entry opening. The sheet P enters an area between the belt 363 and the heat roller 366.

In the fixing device 36A, warming-up is performed as follows. The warming-up of the fixing device 36A is performed before the sheet P enters the fixing device 36A.

At least one of the halogen lamps 366*d* and 366*e* is lighted and the halogen lamp 365*a* is lighted. The lighting control of the halogen lamps 366*d* and 366*e* is performed such that the temperature of the heat roller 366 becomes a fixing temperature which is determined in advance. The lighting control of the halogen lamps 366*d* and 366*e* is performed on the basis of the temperature detected by the thermister 366*f*.

The lighting control of the halogen lamp 365*a* is performed such that the temperature of the belt 363 becomes a belt temperature which is determined in advance. The lighting control of the halogen lamp 365*a* is performed on the basis of the temperature detected by the thermister 365*b*.

The driving motor 369 causes the heat roller 366 to rotate in a counter clockwise direction of FIG. 3.

The heat roller 366 abuts onto the outer circumferential surface 363*a* of the belt 363. The belt 363 is rotatably stretched between the press roller 364A and the belt heat roller 365. The press roller 364A and the belt heat roller 365 rotate in the same direction as the belt 363 due to a frictional force from the inner circumferential surface 363*b* of the belt 363.

In this manner, the temperature of the nip N is maintained at the fixing temperature at which a toner image is fixed to the sheet P. The fixing temperature is selected from a plurality of target temperatures including 180° C., 110° C., and 120° C. according to the type of the sheet P or the type of the toner.

The sheet P to which the toner image is secondarily transferred enters into the nip N in the fixing device 36A which is warmed up as described above. The toner image on the sheet P is fixed on a surface of the sheet P while being heated and pressed at the nip N.

The sheet P receives a particularly greater pressurizing force at the high pressure nip section $N_H$ than at the other portion of the nip N.

After passing through the nip N, the sheet P is separated from the heat roller 366 and the belt 363. The sheet P separated from the heat roller 366 and the belt 363 passes through the discharge opening of the fixing device 36A and is discharged toward the transportation roller 37.

The transportation roller 37 discharges the sheet P to the sheet discharge portion 38.

Then, image formation with respect to the sheet P is completed.

The effect of the fixing device 36A according to this embodiment will be described.

In this embodiment, since the outer circumferential surface 364*a* of the press roller 364A has the normal crown shape, belt deviation of the belt 363 is prevented. The traveling performance of the belt 363 is stabilized.

The shape of the outer circumferential surface 363*a* of the belt 363 conforms to the normal crown shape of the outer circumferential surface 364*a* of the press roller 364A at an area at which the outer circumferential surface 363*a* and the press roller 364A abut onto each other.

In this embodiment, since the outer circumferential surface of the heat roller 366 has the reverse crown shape, the uniformity in width of the high pressure nip section $N_H$ in the circumferential direction of the heat roller 366 is improved.

In this embodiment, the nip N is formed with the belt 363 being wound on the heat roller 366. It is possible to set the nip width of the nip N to an appropriate width by setting the winding amount of the belt 363 to an appropriate amount.

However, it is known that a wrinkle is likely to be generated on the sheet P when the nip width of the nip N is large.

One of causes of the wrinkle is that there is distribution of the transportation speed in the orthogonal-to-transportation direction within the nip N. When the transportation speed of the central portion in the orthogonal-to-transportation direction is larger than the transportation speed of the peripheral portion, the wrinkle is likely to be generated. On the contrary, when the transportation speed of the peripheral portion in the orthogonal-to-transportation direction is larger than the transportation speed of the central portion, generation of the wrinkle is suppressed. This is because the sheet P is transported while being pulled in a direction from the central portion in the orthogonal-to-transportation direction to the peripheral portion when the transportation speed of the peripheral portion is large.

In the high pressure nip section $N_H$, the outer circumferential surface of the heat roller 366 has the reverse crown shape. If the sheet P is transported while being in close contact with the heat roller 366, the transportation speed of the peripheral portion in the orthogonal-to-transportation direction becomes larger than the transportation speed of the central portion. The distribution of the transportation speed of the heat roller 366 can suppress generation of the wrinkle.

In the high pressure nip section $N_H$, the outer circumferential surface 363*a* of the belt 363 has the normal crown shape which conforms to the shape of the press roller 364A. When the belt 363 rotates while being in close contact with the press roller 364A, the transportation speed of the central portion in the orthogonal-to-transportation direction becomes larger than the transportation speed of the peripheral portion. The distribution of the transportation speed of the belt 363 which is affected by the press roller 364A may increase generation of the wrinkle.

It is considered that the belt 363 is likely to rotate in accordance with rotation of the press roller 364A when the frictional force between the press roller 364A and the belt 363 is large. Therefore, the inventors performed an experiment on the dynamic frictional force between the inner circumferential surface 363*b* of the belt 363 and the outer circumferential surface 364*a* of the press roller 364A and the wrinkle generation rate.

Figure 8:
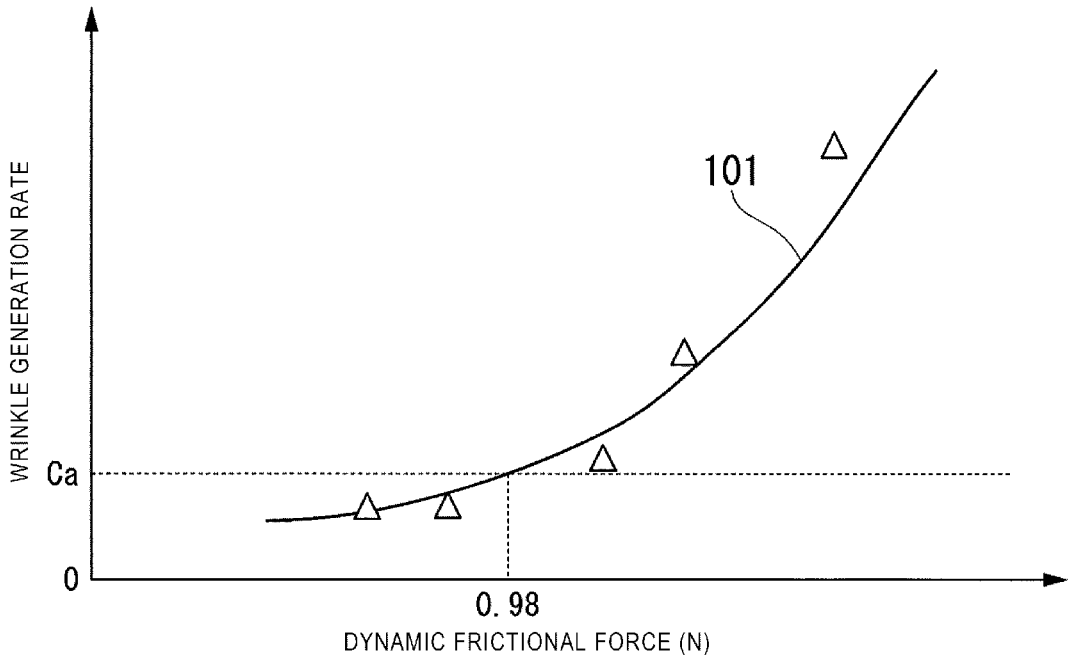
FIG. 8 is a graph illustrating a relationship between the dynamic frictional force and the wrinkle generation rate.
Figure 9:
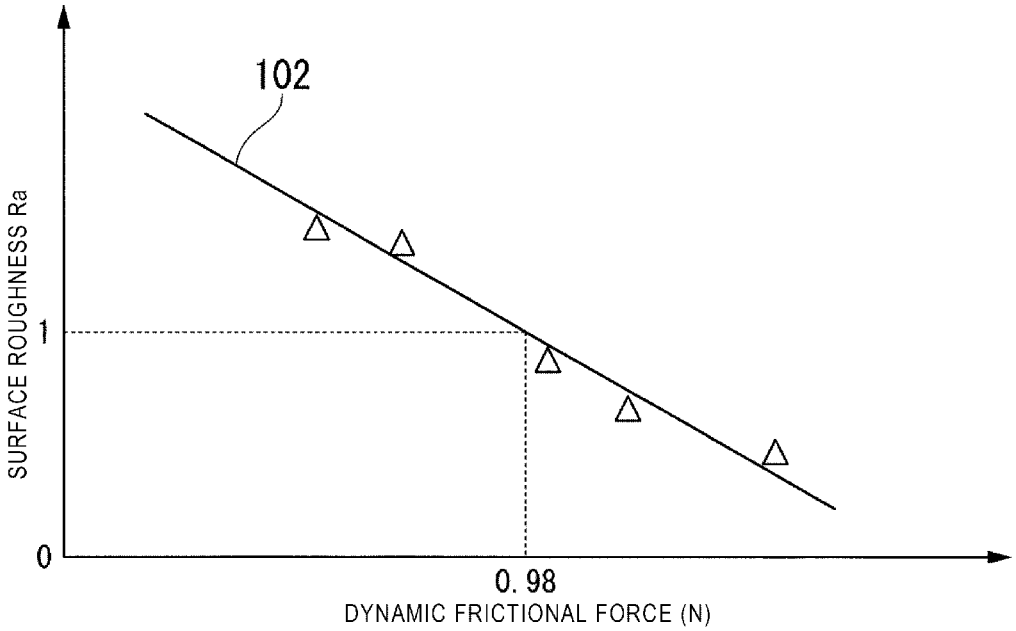
FIG. 9 is a graph illustrating a relationship between the dynamic frictional force and the surface roughness of the inner circumferential surface of a belt of the fixing device.

FIG. 8 is a graph illustrating a relationship between the dynamic frictional force and the wrinkle generation rate. The horizontal axis represents the dynamic frictional force (N) obtained by the above-described measuring method and the vertical axis represents the wrinkle generation rate. The wrinkle generation rate at the origin O is zero. FIG. 9 is a graph illustrating a relationship between the dynamic frictional force and the surface roughness of the inner circumferential surface of the belt of the fixing device. The horizontal axis represents the dynamic frictional force (N) obtained by the above-described measuring method and the vertical axis represents the surface roughness in terms of arithmetic average roughness Ra.

First, the wrinkle generation rate was measured while changing the magnitude of the dynamic frictional force. The magnitude of the dynamic frictional force was changed by changing the surface roughness of the inner circumferential surface 363*b* of the belt 363. As illustrated in FIG. 8, the wrinkle generation rate increased as the dynamic frictional force increased.

If the dynamic frictional force is small, slip is likely to occur between the inner circumferential surface 363*b* of the belt 363 and the outer circumferential surface 364*a* of the press roller 364A. When the slip occurs, the interlocking property between the press roller 364A and the belt 363 decreases. The outer circumferential surface 363*a* of the belt 363 can be integrally moved with the sheet P being in close contact with a rear surface of the sheet P. When the heat roller 366 is driven to rotate, the sheet P is transported according to the transportation speed distribution of the heat roller 366 in the orthogonal-to-transportation direction.

According to a curve 101 obtained by curve approximation of measured values, a dynamic frictional force at which the wrinkle generation rate reaches an allowable value Ca is 0.98 N. In this embodiment, since the dynamic frictional force between the inner circumferential surface 363*b* of the belt 363 and the outer circumferential surface 364*a* of the press roller 364A is set to be equal to or smaller than 0.98 N, it is possible to set the wrinkle generation rate to be equal to or smaller than the allowable value Ca.

A relationship between the dynamic frictional force and the surface roughness Ra in the experiment is as illustrated in FIG. 9. The surface roughness Ra was measured using a surface roughness tester.

As illustrated in FIG. 9, the dynamic frictional force increased as the surface roughness Ra decreased. According to a straight line 102 obtained by linear approximation of measured values, a surface roughness Ra at which the dynamic frictional force reaches 0.98 N is 1. From this, it is found that the dynamic frictional force becomes equal to or smaller than 0.98 N when the surface roughness Ra is equal to or greater than 1.

The true contact area between the inner circumferential surface 363*b* of the belt 363 and the outer circumferential surface 364*a* of the press roller 364A becomes small. It is considered that the dynamic frictional force decreases as the surface roughness Ra increases. However, if the surface roughness Ra exceeds 3, the degree of wear of the inner circumferential surface 363*b* may increase. The surface roughness Ra of the inner circumferential surface 363*b* of the belt 363 is preferably set to be equal to or greater than 1 and equal to or smaller than 3.

As described above, in the fixing device 36A according to this embodiment, the wrinkle generation rate is low since the dynamic frictional force between the inner circumferential surface 363*b* of the belt 363 and the outer circumferential surface 364*a* of the press roller 364A is set to be equal to or smaller than 0.98 N.

Hereinabove, the effect of the fixing device 36A is described focusing on the high pressure nip section $N_H$. In a portion of the nip N other than the high pressure nip section $N_H$, the belt 363 is wound on the heat roller 366. In the portion of the nip N other than the high pressure nip section $N_H$, the belt 363 is transported according to transportation speed distribution which is affected by the reverse crown shape of the heat roller 366. In the portion of the nip N other than the high pressure nip section $N_H$, the wrinkle is not likely to be generated even if the nip width is large.

Modification Example

Next, a fixing device according to a modification example of the embodiment will be described.

As illustrated in FIG. 3, a fixing device 36B in this modification example includes a press roller 364B (the second rotator) instead of the press roller 364A of the fixing device 36A according to the embodiment.

Instead of the fixing device 36A according to the embodiment, the fixing device 36B may be used for the image forming apparatus 10.

As illustrated in FIG. 6, the press roller 364B is different from the press roller 364A in a point that a low friction coat 364*b* is formed on a surface of the elastic layer 364*e* of the press roller 364A according to the embodiment.

As the low friction coat 364*b*, an appropriate coat having a lower friction coefficient than the surface of the elastic layer 364*e* is used. For example, examples of the low friction coat 364*b* include a fluorine coat, a silicon coat, and the like. For example, if the elastic layer 364*e* is constituted by a silicon rubber layer, a fluorine coat may be formed as the low friction coat 364*b*.

The low friction coat 364*b* constitutes an outer circumferential surface of the press roller 364B.

According to the fixing device 36B of this modification example, the inner circumferential surface 363*b* of the belt 363 abuts onto the low friction coat 364*b*. The low friction coat 364*b* is the outer circumferential surface of the press roller 364B. According to the fixing device 36B, the dynamic frictional force between the inner circumferential surface 363*b* of the belt 363 and the outer circumferential surface of the press roller 364B is further decreased. The wrinkle generation rate in the fixing device 36B can be further decreased in comparison with the fixing device 36A.

Here, Experimental Examples 1 to 8 for describing the effect of the low friction coat 364*b* will be described.

Conditions and evaluation results of Experimental Examples 1 to 8 are described in following Table 1.

TABLE 1

| | Belt | Press roller | Dynamic frictional force (N) | Wrinkle occurrence rate evaluation |
|---|---|---|---|---|
| Experimental Example 1 | a | A | 1.00 | NG |
| Experimental Example 2 | b | A | 1.23 | NG |
| Experimental Example 3 | c | A | 1.63 | NG |
| Experimental Example 4 | d | A | 1.08 | NG |
| Experimental Example 5 | a | B | 0.71 | OK |
| Experimental Example 6 | b | B | 1.09 | NG |
| Experimental Example 7 | c | B | 0.94 | OK |
| Experimental Example 8 | d | B | 0.80 | OK |

As described in Table 1, in fixing devices of respective experimental examples, four kinds of belts a, b, c, and d were used. The belts a, b, c, and d are different in surface roughness Ra of an inner circumferential surface.

A press roller A which is used in Experimental Examples 1 to 4 has an exposed resin layer as an outer circumferential surface. A press roller B which is used in Experimental Examples 5 to 8 is obtained by forming a low friction coat on the outer circumferential surface of the press roller A.

Evaluations performed in the experimental examples include dynamic frictional force measurement which is described above and wrinkle generation rate evaluation.

The wrinkle generation rate evaluation is performed by using image forming apparatuses in which respective fixing devices of the experimental examples are installed. In Table 1, "OK" indicates a case where the wrinkle generation rate is equal to or smaller than the allowable value Ca and "NG" indicates a case where the wrinkle generation rate exceeds the allowable value Ca.

As shown in Table 1, in Experimental Examples 5, 7, and 8 in which the dynamic frictional force was equal to or smaller than 0.98N, the result of the wrinkle generation rate evaluation was "OK". On the other hand, in Experimental Examples 1 to 4 and 6 in which the dynamic frictional force exceeded 0.98 N, the result of the wrinkle generation rate evaluation was "NG".

From the above results, it can be found that the wrinkle generation rate can be decreased if the dynamic frictional force is equal to or smaller than 0.98 N.

In the description of the above-described embodiment, FIG. 6 illustrates an exemplary case where the press rollers 364A and 364B and the cored bar 364*d* have a hollow pipe-like shape. However, a solid rod also may be used as the cored bar 364*d*.

In the description of the above-described embodiment, an example in which the heat roller 366 and the belt heat roller 365 are respectively heated by the halogen lamps 366*d*, 366*e*, and 365*a* is described. However, a unit that heats the heat roller 366 and the belt heat roller 365 is not limited to a halogen lamp. For example, the heat roller 366 and the belt heat roller 365 may be heated by a resistance heat generation heater, an IH heater, or the like.

In the description of the above-described embodiment, an example in which the belt 363 is stretched between two rollers of the press roller 364A (364B) and the belt heat roller 365 is described. However, the belt 363 may be stretched among three or more rollers.

According to at least one of the embodiments described above, it is possible to provide a fixing device and an image forming apparatus in which a wrinkle is unlikely to be generated on a sheet even with a wide nip width.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A fixing device comprising:

a first rotator;

a belt that forms a nip by abutting onto a surface of the first rotator; and a second rotator that is disposed to abut onto an inner circumferential surface of the belt and that presses the belt against the first rotator such that the dynamic frictional force between the inner circumferential surface of the belt and the second rotator becomes equal to or smaller than 0.98 N.

2. The device according to claim 1, wherein the surface roughness of the inner circumferential surface of the belt is equal to or greater than 1 and equal to or smaller than 3 in terms of arithmetic average roughness Ra.

3. The device according to claim 1, wherein the second rotator includes a cored bar which is made of metal and an elastic layer which covers the cored bar.

4. The device according to claim 3, wherein the thickness of the elastic layer is equal to or greater than 1 mm and equal to or smaller than 3 mm.

5. The device according to claim 3, wherein a low friction coat is formed on a surface of the elastic layer.

6. The device according to claim 1, wherein the shape of an outer circumferential surface of the first rotator is a reverse crown shape, and wherein the shape of an outer circumferential surface of the second rotator is a normal crown shape.

7. The device according to claim 1, wherein the width of the nip in a circumferential direction of the first rotator is equal to or greater than 12 mm and equal to or smaller than 20 mm.

8. The device according to claim 1, wherein the first rotator rotates by being driven by a motor, and wherein the second rotator rotates in accordance with rotation of the first rotator.

9. The device according to claim 1, wherein a heat source that supplies heat to the nip is provided in the first rotator.

10. An image forming apparatus comprising:

the fixing device according to claim 1.

* * * * *